United States Patent [19]

Saito

[11] Patent Number: 5,069,189

[45] Date of Patent: Dec. 3, 1991

[54] FUEL INJECTOR SYSTEM FOR INTERNAL COMBUSTION ENGINE

[75] Inventor: Chitoshi Saito, Hamamatsu, Japan

[73] Assignee: Sanshin Kogyo Kabushiki Kaisha, Hamamatsu, Japan

[21] Appl. No.: 544,422

[22] Filed: Jun. 27, 1990

[30] Foreign Application Priority Data

Jun. 27, 1989 [JP] Japan ..... 1-164380

[51] Int. Cl.[5] ..... F02M 68/08

[52] U.S. Cl. ..... 123/533; 123/549; 251/129.22

[58] Field of Search ..... 123/179 L, 179 H, 531, 123/532, 533, 534, 549, 557, 585; 239/533.2, 533.4, 585; 251/129.22

[56] References Cited

U.S. PATENT DOCUMENTS

| | | | |
|---|---|---|---|
| 4,753,213 | 6/1988 | Schlunke et al. | 123/533 |
| 4,771,754 | 9/1988 | Reinke | 123/533 |
| 4,886,032 | 12/1989 | Asmus | 123/557 |
| 4,887,769 | 12/1989 | Okamoto et al. | 251/129.22 |
| 4,936,279 | 6/1990 | Ragg | 123/533 |
| 4,962,745 | 10/1990 | Ohno et al. | 123/533 |
| 4,969,435 | 11/1990 | Morikawa et al. | 123/533 X |
| 4,971,291 | 11/1990 | Cristiani et al. | 251/129.22 |
| 4,979,479 | 12/1990 | Furukawa | 123/531 X |

FOREIGN PATENT DOCUMENTS

| | | | |
|---|---|---|---|
| 63-248965 | 10/1988 | Japan . | |
| 2222435 | 3/1990 | United Kingdom | 123/531 |

*Primary Examiner*—Willis R. Wolfe

*Attorney, Agent, or Firm*—Ernest A. Beutler

[57] ABSTRACT

Two embodiments of fuel/air injectors for an internal combustion engine wherein the main air delivery valve is actuated by a solenoid having a winding and wherein the solenoid winding is cooled by fuel in a jacket surrounding it which fuel is also delivered to the fuel injector. In one embodiment, the fuel injector solenoid and air control valve are all coaxial and in the other embodiment the fuel injector injects perpendicularly to the delivery valve and the solenoid.

13 Claims, 3 Drawing Sheets

FUEL INJECTOR SYSTEM FOR INTERNAL COMBUSTION ENGINE

BACKGROUND OF THE INVENTION

This invention relates to a fuel injector system for an internal combustion engine and more particularly to an improved cooling arrangement and construction for such an injector nozzle.

One form of fuel injection nozzle injects not only fuel but compressed air into the engine. With this type of injection nozzle, it is the normal practice to provide a housing in which a fuel injector is mounted and which forms an air chamber with the discharge of the air and, in some instances the fuel, being controlled by a solenoid operated valve. Obviously the rapid pulsation of the valve during engine operation can give rise to significant heat due to the successive energizations of the solenoid coil. The generation of said heat can give rise to a number of problems, as should be readily apparent.

Although it has been proposed to provide an air cooling arrangement for the solenoid coil, such systems have not been fully satisfactory. In the first instance, it is difficult to provide sufficient air flow for cooling. In addition, if an air cooling system is employed, there must be provided seals that preclude air leakage into the valve mechanism and past the control valve. These seals frequently must cooperate with the valve stem and thus can impede its operation.

It is, therefore, a principal object of this invention to provide an improved fuel injection system including a cooling arrangement for the actuating solenoid of the valve.

It is a further object of this invention to provide an improved arrangement for cooling the solenoid of a fuel injection system.

It is a yet further object of this invention to provide an improved arrangement for cooling a fuel injection nozzle solenoid without impeding the other operation of the mechanism.

As has been noted, one type of fuel injection system also injects air in addition to fuel into the engine. With this type of system, the air control valve is generally coaxially mounted in the injector housing and a fuel injection nozzle is mounted in this housing in a transverse relationship to the air passage. As a result, the valve stem must be relatively long between the solenoid and the actual valving element. In addition, this transverse placement gives rise to a rather bulky assembly which can, in many instances, make optimal placement of the injection nozzle difficult if not impossible.

It is, therefore, a still further object of this invention to provide an improved and compact fuel/air injection nozzle.

SUMMARY OF THE INVENTION

A first feature of this invention is adapted to be embodied in a fuel/air injector unit for injecting fuel and air under pressure into an internal combustion engine and comprises a fuel injector for injecting fuel. An air delivery valve is provided for controlling the delivery of air and the air delivery valve includes a solenoid for operating the air delivery valve. The solenoid has a winding and a cooling jacket is provided in proximity to the winding. Means are provided for circulating fuel through the cooling jacket for cooling the solenoid winding.

Another feature of the invention is adapted to be embodied in a fuel/air injector for injecting fuel and air under pressure into an internal combustion engine. In accordance with this feature of the invention, the injector has a housing with a coaxially disposed air control valve and a solenoid, which is also coaxially disposed, for operating this valve. A fuel injector is also disposed coaxially into the housing and discharges fuel in a generally axial direction.

DETAILED DESCRIPTION OF THE PREFERRED EMBODIMENT OF THE INVENTION

Figure 1:
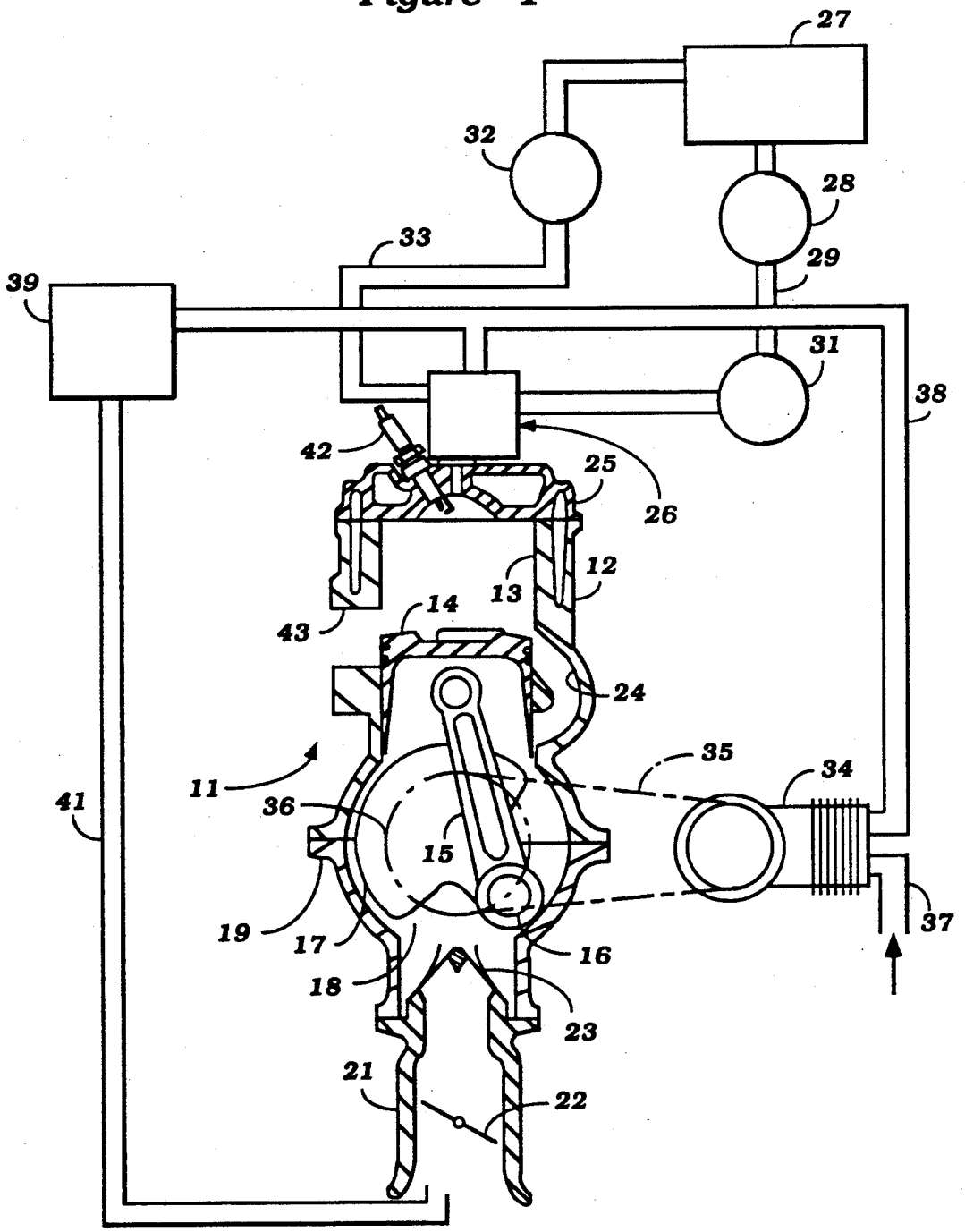
FIG. 1 is a partially schematic cross-sectional view showing a single cylinder of an internal combustion engine constructed and operating in accordance with an embodiment of the invention.

Referring first to FIG. 1, a single cylinder of a two-cycle crankcase compression internal combustion engine having a fuel/air injection unit constructed in accordance with an embodiment of the invention is identified generally by the reference numeral 11. Only a single cylinder of the engine 11 is depicted because it is believed that those skilled in the art can readily understand how the invention can be employed in connection with multiple cylinder engines. Also, although the invention is described in conjunction with a reciprocating engine, the invention can be equally as well practiced with other types of engines and also engines that operate on other than the crankcase compression principal. However, the invention does have particular utility in conjunction with two-cycle engines.

The engine 11 includes a cylinder block 12 formed with a cylinder bore 13 in which a piston 14 reciprocates. The piston 14 is connected by means of a connecting rod 15 to a throw 16 of a crankshaft, indicated at 17 for driving the crankshaft in a known manner.

The crankshaft 17 is rotatably journalled within a crankcase chamber 18 that is formed by the cylinder block 12 and a crankcase 19 that is affixed to the cylinder block in any suitable manner. An air charge is delivered to the crankcase chamber 18 through an intake manifold 21 in which a flow controlling throttle valve 22 is positioned. A reed type check valve 23 is interposed between the intake manifold 21 and the crankcase chamber 18 so as to preclude reverse flow, as is well known in this art. The charge which has been admitted to the crankcase chamber 18 will be compressed during downward movement of the piston 14 and then is transferred to the combustion chamber through one or more scavenge ports 24.

A cylinder head 25 is affixed to the cylinder block 12 and supports a fuel/air injection unit, indicated generally by the reference numeral 26 and constructed in accordance with an embodiment of the invention. The construction of the fuel/air injection unit 26 will be described later by reference to FIG. 2.

Fuel is supplied to the fuel/air injection unit 26 from a remotely positioned fuel tank 27 by means of a fuel pump 28 and conduit 29. A fuel filter 31 is provided in this conduit 29 and filters the fuel delivered to the fuel- /air injection unit 26. A pressure relief valve 32 is positioned in a return conduit 33 that leads back to the fuel tank 27 and which maintains a uniform head of fuel in the fuel/air injector unit 26 by bypassing excess fuel back to the tank 26.

Compressed air is delivered to the fuel/air injection unit 26 from an air compressor 34. The air compressor 34 is driven by means of a belt 35 from a pulley 36 that is affixed to the crankshaft 17 for rotation with it. The compressor 34 draws air from the atmosphere through an inlet 37 and delivers it to the fuel/air injection unit 26 by means of a supply conduit 38. The air pressure is regulated by a pressure regulator 39 which regulates the air pressure by returning excess air to the induction manifold 21 through a bypass conduit 41.

A spark plug 42 is provided in the cylinder head 26 for firing the fuel/air charge generated both by the injector unit 26 and the induction system already described. The burnt fuel/air charge is then discharged to the atmosphere through an exhaust port 43.

It should be understood that the engine construction as thus far described, may be considered to be conventional for the purpose of this invention. For that reason, further details of the construction of the engine and its operation is not believed to be necessary.

Figure 2:
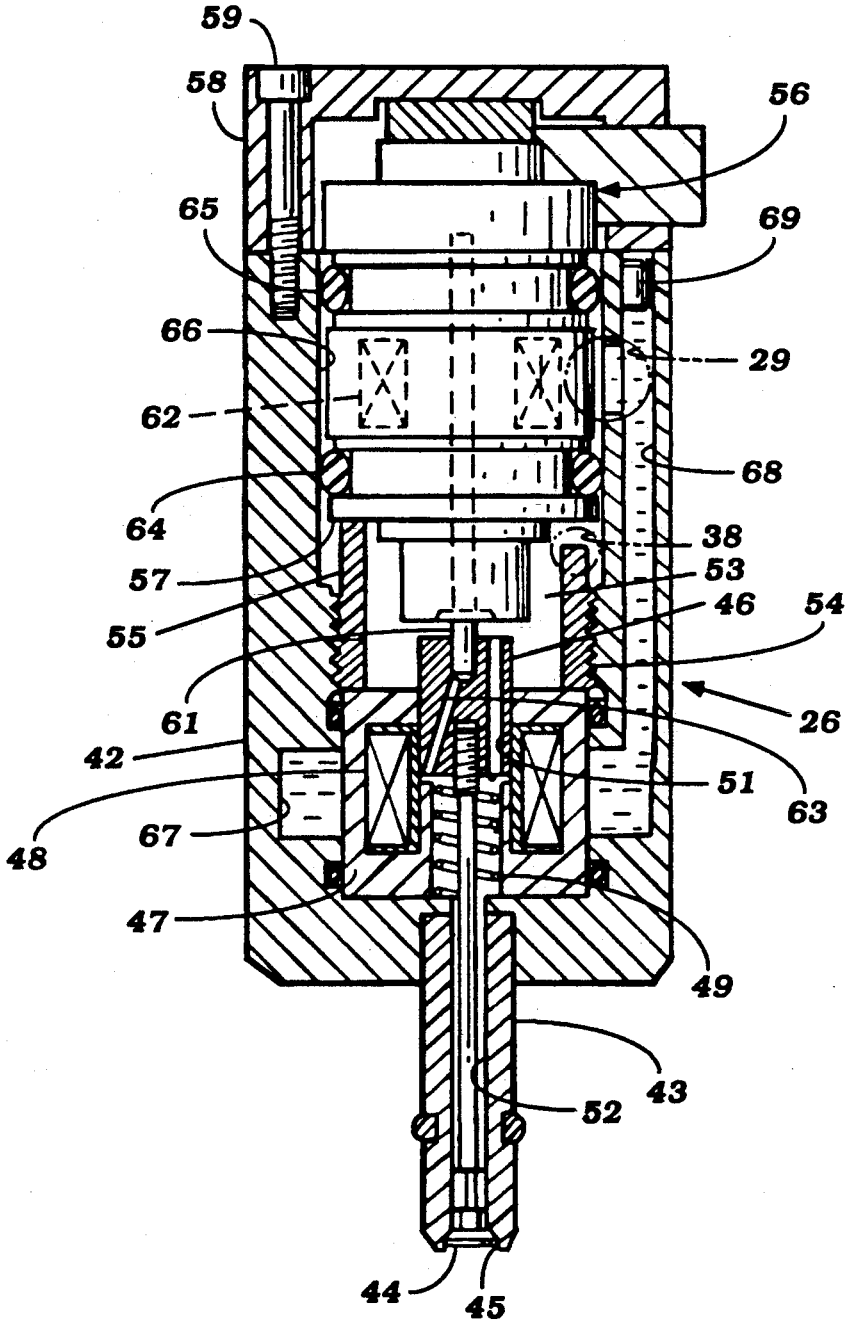
FIG. 2 is an enlarged cross-sectional view of the fuel/air injection unit.

As has been previously noted, the invention relates to the fuel/air injection unit 26 and this unit will now be described by particular reference to FIG. 2.

The fuel/air injection unit 26 is comprised of a main housing that consists of a primary piece 42 having an injector nozzle portion 43 extending from its lower end. A poppet type control valve 44 is supported within a bore of the injection portion 43 and has a head portion that cooperates with a seat 45 so as to control both the admission of air and fuel to the engine.

The valve 44 has an armature portion 46 affixed to its upper end and which is contained within a bore of a solenoid, indicated generally by the reference numeral 47 and having a winding 48. A coil compression spring 49 is interposed between the housing piece 42 and the armature 46 for urging the valve 44 to its closed position. When the winding 48 is energized, the armature 46 will be drawn downwardly and the valve 44 will be opened.

The armature 46 is provided with an air passage 51 that extends generally coaxilly through the assembly but which is offset to one side of the reciprocal axis of the valve 44. This passage 55 communicates a chamber 52 formed in the nozzle portion 43 with an air chamber 53 that is formed in the housing 42. Air is delivered under pressure to this chamber 53 through the conduit 38 in the manner as aforedescribed.

The solenoid 47 is held axially within the housing 42 by means of a threaded locking ring 54. A spacer ring 55 not only holds this locking ring 54 in position but also provides a support for a fuel injector, indicated generally by the reference numeral 56. The fuel injector 56 has a shoulder 57 that is held in engagement with the ring 55 by means of a cover plate 58 that is affixed to the main housing piece 42 by means of a plurality of socket headed screws 59. The fuel injector 56 is also of the solenoid type and has an armature or valve member 61 that is operated by means of a solenoid winding 62. Fuel issuing from the injector 56 is discharged into a passageway 63 that is formed within the armature 46 and which communicates with the chamber 52 below this armature. Fuel is delivered to the injector 56 through the conduit 38 in the manner previously described. Fuel leakage is prevented by means of a pair of O-ring seals 64 and 65 which sealingly engage a counterbore 66 formed in the main housing piece 42.

The sequence of operating the fuel injector 56 and the air injection valve 44 can be of any known type. It should be readily apparent that fuel injected into the chamber formed by the bore 52 will be discharged along with compressed air when the valve 46 is opened.

In accordance with the invention, a cooling jacket 67 is formed in the housing piece 42 around the solenoid 47 and specifically its winding 48. Fuel is delivered to this cooling jacket from the fuel conduit 38 through an axially extending delivery passage 68 that is formed in the housing piece 42 at one side of the counterbore 66 and which is closed at its upper end by a closure plug 69. As a result, the delivery of fuel to the injector 56 will provide a fuel flow through the cooling jacket 67 which cools the solenoid 47 and specifically its winding 48. In addition to this advantage, the coaxial disposition of the air valve 44 and the fuel injector 56 provides a very compact assembly. Furthermore, since the fuel injector 56 is disposed coaxially and is spaced above the solenoid 47, the solenoid 47 can be kept quite close to the valve 44 and extremely good response is provided.

Figure 3:
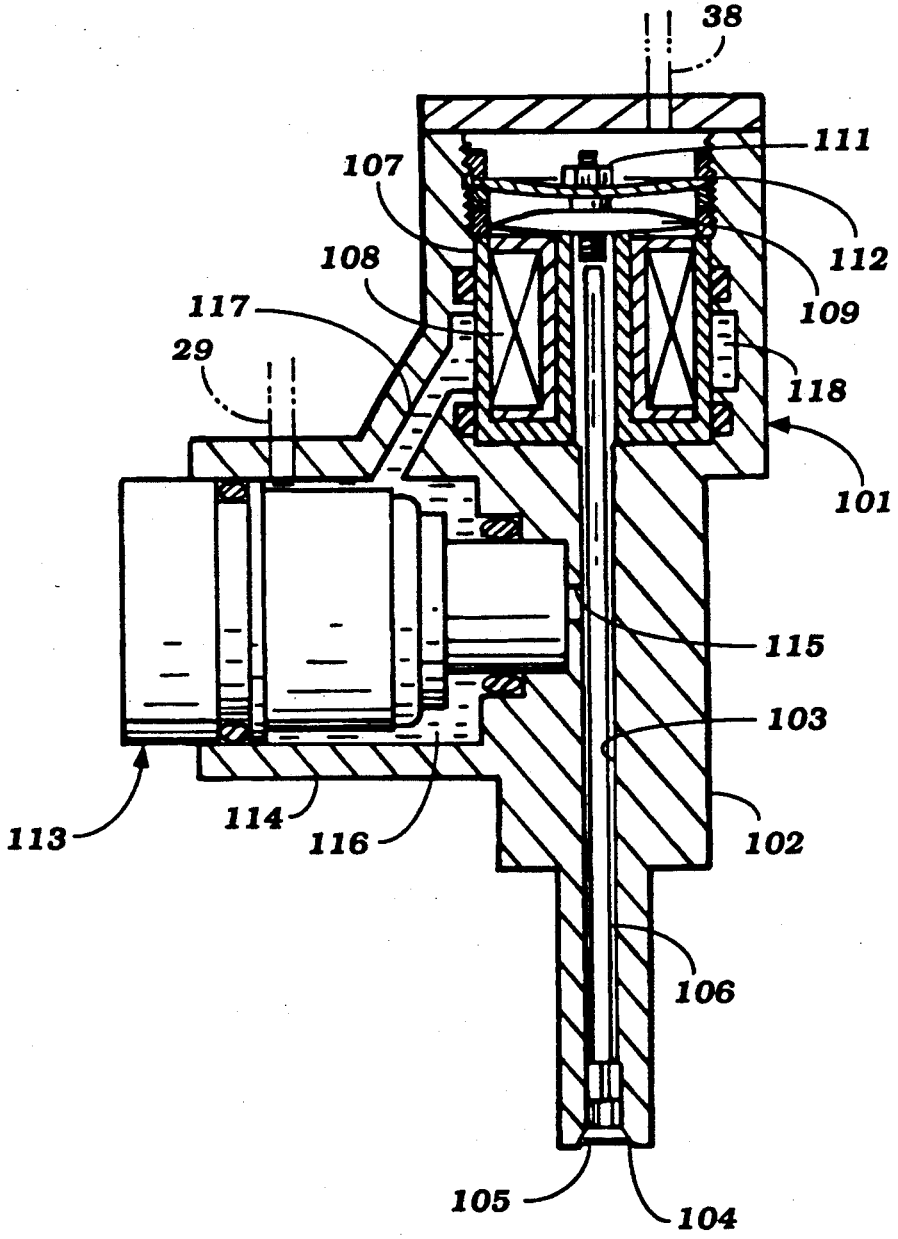
FIG. 3 is a cross-sectional view, in-part-similar to FIG. 2, and shows another embodiment of the invention.

Another embodiment of fuel/air injection unit constructed in accordance with the invention is identified generally by the reference numeral 101 in FIG. 3. This fuel/air injection unit 101 does not have the compactness advantages of the embodiment of FIG. 2 but shows how the provision of a cooling jacket around the solenoid of the air control valve may be employed in conjunction with a more conventional fuel/air injection unit. The construction of this figure also shows how the transverse disposition of the conventional construction removes the solenoid a substantial distance from the air control valve and also makes a more bulky assembly.

Referring specifically to this figure, the injector unit 101 has a main housing portion 102 in which a longitudinally extending bore 103 is formed. The lower end of the bore 103, terminates at a valve seat 104 with which the head 105 of a poppet type valve 106 cooperates. The stem of the poppet valve 106 is smaller than the diameter of the bore 103 so as to provide an air chamber.

Disposed at the opposite axial end from the valve head 105 in the housing 102 is a solenoid 107 having a winding 108. The winding 108 cooperates with an armature 109 that is affixed to the valve 106 by a nut 111 that is fixed to a threaded upper portion of the valve stem. A belville type spring 112 cooperates with the armature 109 and normally urges the valve 105 to its closed position. When the winding 108 is energized, the valve 106 will be drawn downwardly and the head portion 104 will open to permit the injector 101 to discharge.

Compressed air is delivered to the bore 103 from a compressed air inlet, such as the supply conduit 38 described in conjunction with FIG. 1.

A fuel injector indicated generally by the reference numeral 113, which may be also of the solenoid type, is mounted in a transverse extension 114 of the housing 102 between the solenoid 107 and the valve seat 104. It should be readily apparent that this orientation greatly increases the distance between the solenoid 107 and the valve head 105 from the previously described embodiment.

Fuel is delivered to the injector 105 through a conduit, such as the conduit 29 from the previously described embodiment and this fuel is then discharged through a transversely extending passage 115 into the bore 103 for delivery when the valve 106 is opened. A fuel chamber 116 surrounds both the fuel injector 103 and communicates with a passageway 117 that communicates with a cooling jacket 118 surrounding the solenoid 107 and specifically its winding 108. Thus, like the previously described embodiment, the fuel delivered to the injection nozzle 113 in this embodiment can be employed for cooling the solenoid 107 and particularly its winding 108.

It should be readily apparent that the foregoing constructions are highly effective in providing an arrangement for effectively cooling the solenoid coil associated with the control valve of a fuel/air injection unit without requiring seals on the valve stem or its actuating element and without significantly adding to the bulk of the unit. In addition, one of the embodiments of the invention also provides a very compact assembly wherein the solenoid can be positioned quite close to the valve element so as to improve responsiveness. Although two embodiments of the invention have been illustrated and described, various changes and modifications may be made without departing from the spirit and scope of the invention, as defined by the appended claims.

I claim:

1. A fuel/air injector unit for injecting fuel and air under pressure into an internal combustion engine comprising a fuel injector for injecting fuel, an air delivery valve for controlling the delivery of air, said air delivery valve including a solenoid for operating said air delivery valve, said solenoid having a winding, cooling jacket in proximity to said winding, and means for circulating fuel through said cooling jacket.

2. A fuel/air injector unit as set forth in claim 1, wherein the fuel circulated through the cooling jacket is fuel delivered to the fuel injector.

3. A fuel/air injector unit as set forth in claim 2, wherein the fuel injector and air delivery valve are coaxial with each other.

4. A fuel/air injector unit as set forth in claim 3, wherein the air delivery valve controls the delivery of both air and fuel to the engine.

5. A fuel/air injector unit as set forth in claim 4, wherein the fuel injector injects fuel to a chamber the discharge end of which communicates with the air delivery valve and which is coaxial with the air delivery valve, the fuel injector and the solenoid.

6. A fuel/air injector unit as set forth in claim 5, wherein the fuel injector injects fuel into the cavity through a passage formed in an armature associated with the solenoid winding and the air delivery valve for operating the air delivery valve.

7. A fuel/air injector unit as set forth in claim 2, wherein the fuel injector injects fuel in a perpendicular direction relation relative to the direction of fuel flow.

8. A fuel/air injector unit as set forth in claim 7, wherein the air delivery valve controls the delivery of both air and fuel to the engine.

9. A fuel/air injector unit as set forth in claim 8, wherein the fuel injector injects fuel to a chamber the discharge end of which communicates the air delivery valve and which is coaxial with the air delivery valve, and the solenoid.

10. A fuel/air injector unit for injecting fuel and air under pressure into an internal combustion engine comprising a housing having a discharge nozzle portion containing a chamber and a discharge port, a control valve slid ably supported within said chamber and having a head portion controlling the opening and closing of said port, a solenoid associated with said control valve for opening and closing said control valve and a fuel injector for delivering fuel to said chamber, said valve, said solenoid and said fuel injector all being coaxially disposed relative to each other in the housing.

11. A fuel/air injector unit as set forth in claim 10, wherein the solenoid is positioned adjacent the valve and the fuel injector is positioned on the opposite side of the solenoid from the valve.

12. A fuel/air injector unit as set forth in claim 11, wherein the fuel injector injects fuel to a chamber the discharge end of which communicates with the air delivery valve and which is coaxial with the air delivery valve, the fuel injector and the solenoid.

13. A fuel/air injector unit as set forth in claim 12, wherein the fuel injector injects fuel into the cavity through a passage formed in an armature associated with the solenoid winding and the air delivery valve for operating the air delivery valve.

* * * * *

UNITED STATES PATENT AND TRADEMARK OFFICE

CERTIFICATE OF CORRECTION

PATENT NO. : 5,069,189

DATED : December 3, 1991

INVENTOR(S) : Chitoshi Saito

It is certified that error appears in the above-identified patent and that said Letters Patent is hereby corrected as shown below:

Column 6, line 17, Claim 9, after "communicates" insert --with--.

Column 6, line 18, Claim 9, after "valve," insert --the fuel injector--.

Column 6, line 24, Claim 10, "slid ably" should be --slidably--.

Signed and Sealed this

Seventh Day of September, 1993

Bruce Lehman

*Attest:*

BRUCE LEHMAN

*Attesting Officer*

*Commissioner of Patents and Trademarks*